US009115582B2

(12) United States Patent
Kingsley

(10) Patent No.: US 9,115,582 B2
(45) Date of Patent: Aug. 25, 2015

(54) STOPE FILL BARRIER

(71) Applicant: Jollan Kingsley, Mahogany Creek (AU)

(72) Inventor: Jollan Kingsley, Mahogany Creek (AU)

( * ) Notice: Subject to any disclaimer, the term of this patent is extended or adjusted under 35 U.S.C. 154(b) by 0 days.

(21) Appl. No.: 13/945,944

(22) Filed: Jul. 19, 2013

(65) Prior Publication Data

US 2014/0023444 A1 Jan. 23, 2014

(30) Foreign Application Priority Data

Jul. 20, 2012 (AU) ..... 2012903102

(51) Int. Cl.
*E21F 15/04* (2006.01)
*E21C 41/16* (2006.01)

(52) U.S. Cl.
CPC ..... *E21F 15/04* (2013.01); *E21C 41/16* (2013.01)

(58) Field of Classification Search
CPC ..... E21F 15/04; E21C 41/16
USPC ..... 405/288, 289; 299/10, 11
See application file for complete search history.

(56) References Cited

U.S. PATENT DOCUMENTS

| | | | | |
|---|---|---|---|---|
| 2,990,166 | A * | 6/1961 | Walsh | 299/11 |
| 4,906,133 | A * | 3/1990 | Martin | 405/289 |
| 8,070,394 | B2 * | 12/2011 | Skarbovig | 405/289 |
| 8,424,973 | B2 | 4/2013 | Bodley et al. | |
| 2003/0173819 | A1 * | 9/2003 | Hames et al. | 299/19 |
| 2008/0190032 | A1 * | 8/2008 | Roelofs | 49/463 |
| 2010/0295359 | A1 * | 11/2010 | Bodley et al. | 299/13 |

* cited by examiner

*Primary Examiner* — Frederick L Lagman
(74) *Attorney, Agent, or Firm* — The Webb Law Firm

(57) ABSTRACT

A system for mining includes the use of a stope fill barrier having a fluid-fillable bladder for temporarily filling a portion of a stope void directly adjacent to ore to be mined and creating a barrier between the stope void and adjacent ore. The stope fill barrier is installed and positioned in the stope void from below the adjacent ore.

11 Claims, 3 Drawing Sheets

STOPE FILL BARRIER

FIELD OF THE INVENTION

The present invention relates to a stope fill barrier.

BACKGROUND

Frequently, valuable minerals are naturally occurring in ore bodies located in subterraneous deposits. Due to the location of these deposits, often far beneath the surface of the earth and within hard rock, methods of mining to remove them are required.

A modern and presently used method for underground mining entails the removal of ore from a panel of rock, known as a stope. The stope is accessible via an access drive cut into the earth in the level below the ore body to be mined The rock and ore of the stope are fragmented and removed using explosives and once the area has been mined, a stope void remains. This space cannot be left within the ground and, as such, the void is backfilled to fill the created underground space.

Rock must be fragmented by blasting operations to enable its collection and removal from a mine Fragmented rock needs to expand into additional space due to its increased volume. Once a stope void has been backfilled, all space has been removed. Hence subsequent ore collection operations are delayed by the need for creating space blasted rock fragments. Commonly, slot rise holes are drilled up from the access drive, in the ore adjacent to the backfilled stope. These holes provide the necessary space for expanded rock. Explosives are then used to fragment the rock which enables its removal. The drilling of slot rise holes into which blasted rock is allowed to expand is both costly and time-consuming.

The present invention attempts to overcome at least in part the aforementioned disadvantages of previous methods of mining.

SUMMARY OF THE INVENTION

In accordance with one aspect of the present invention there is provided a system for mining comprising the use of a stope fill barrier having a fluid-fillable bladder for temporarily filling a portion of a stope void directly adjacent to ore to be mined and creating a barrier between the stope void and adjacent ore, wherein the stope fill barrier is installed and positioned in the stope void from below the ore.

The stope fill barrier may be installed and positioned from an access drive beneath the ore to be mined The stope fill barrier may be installed and positioned from an access drive beneath the ore to be mined and a shaft may be drilled from between an upper surface of the access drive and the stope void for the stope fill barrier to be installed from.

An end of the shaft at the stope void may be located proximal to a top of the ore.

The portion of the stope void filled by the stope fill barrier may be between 50% and 100% of a length between a top of the stope void and a lower surface of the ore.

The bladder may be filled with fluid subsequent to installation.

The stope void may be backfilled with the stope fill barrier installed within the stope void.

The stope fill barrier may be anchored in place using tensioned ropes or cables fixed to anchor points below the ore.

The fillable bladder may be in connection with at least one pressure regulator to maintain pressure of the fluid-filled bladder.

The fluid-filled bladder may be capable of holding fluid pressures of between 0.5 psi and 50 psi.

The bladder may be made from a hard-wearing, heavy duty, puncture resistant material.

The bladder may comprise a plurality of bladders contained within an outer bag.

The bladder may be arranged to be inflated with air.

BRIEF DESCRIPTION OF DRAWINGS

The present invention will now be described, by way of example, with reference to the accompanying drawings, in which.

DESCRIPTION OF THE PREFERRED EMBODIMENT

Figure 1:
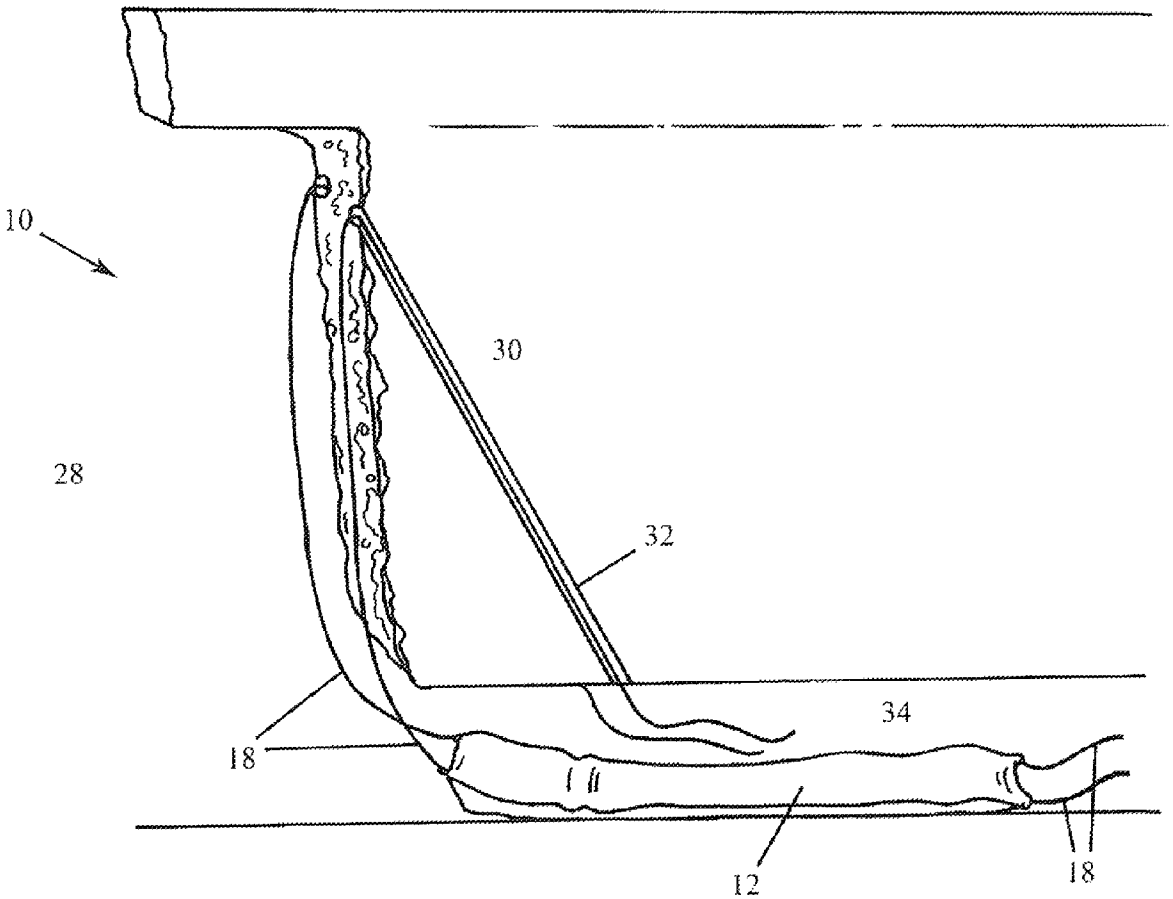
FIG. 1 is a perspective view of a system for using a stope fill barrier according to a preferred embodiment of the present invention in an installed, filled position.
Figure 2:
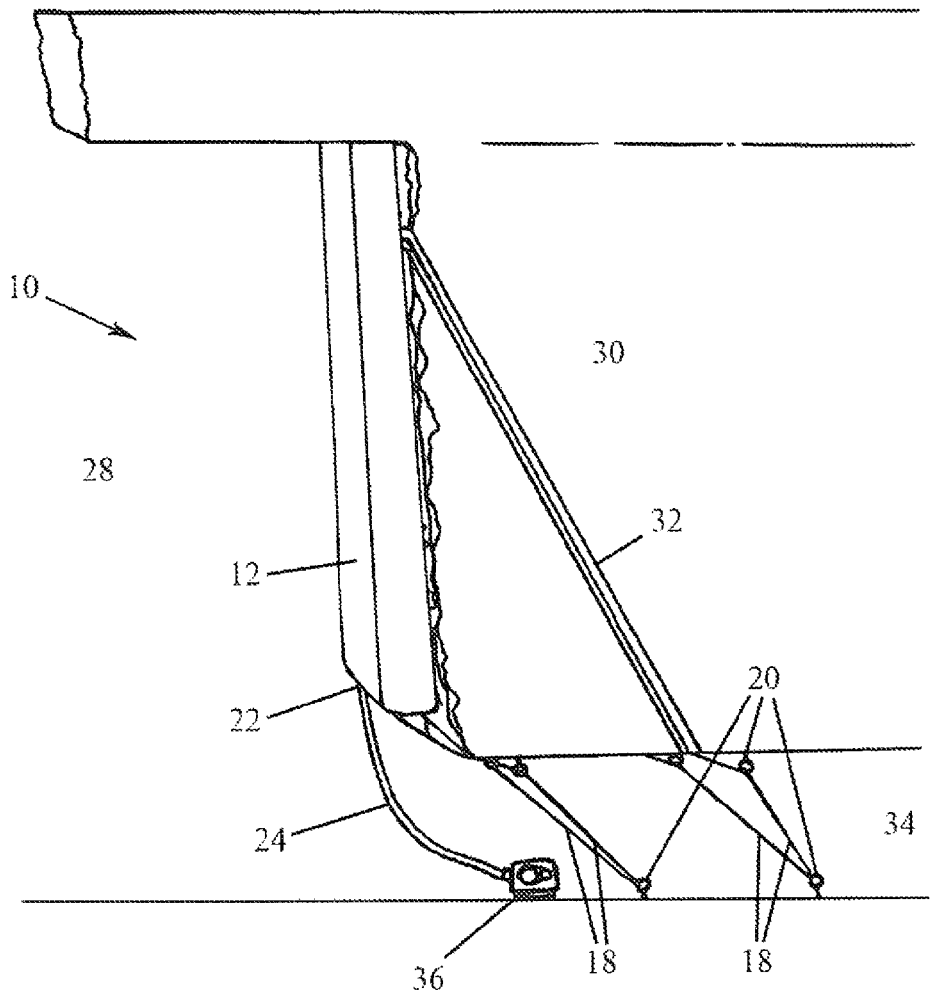
FIG. 2 is a perspective view of the system of FIG. 1 in an un-installed, unfilled position.

Referring to FIGS. 1 and 2, there is shown a system for temporarily filling a vertical part of a stope void 28 directly adjacent to ore to subsequently be mined, or stope 30, comprising the use of a stope fill barrier 10 comprising a fillable bladder 12 for filling part of the stope void 28 and creating a barrier between the void 28 and adjacent ore 30, wherein the stope fill barrier 10 is installed and positioned in the stope void 28 from below the stope 30, such as from an access drive 34, in accordance with the present invention.

The stope fill bather 10 comprises a connection 22 adapted for coupling with fluid lines 24 connected to a filling means 36. The stope fill barrier 10 further comprises ropes or cables 18 which, in use, facilitate the installation and positioning of the stope fill barrier 10. In accordance with a preferred embodiment of the present invention, at least two ropes or cables 18 may be connected with a lower end of the bladder 12 and at least two ropes or cables may be connected with an upper end of the bladder 12.

In accordance with the system of the present invention, anchor points 20, for example eye bolts, are provided on the access drive 34. In a preferred embodiment, at least two anchor points 20 are provided respectively on an upper surface and a lower surface of the access drive 34. At least one access shaft 32 is provided between the access drive 34 and the stope void 28. Preferably, the access shaft 32 is drilled from below in a diagonal from the upper surface of the access drive 34 remote from the stope void 28 to the stope void at an upper region of the next stope 30.

Figure 3:
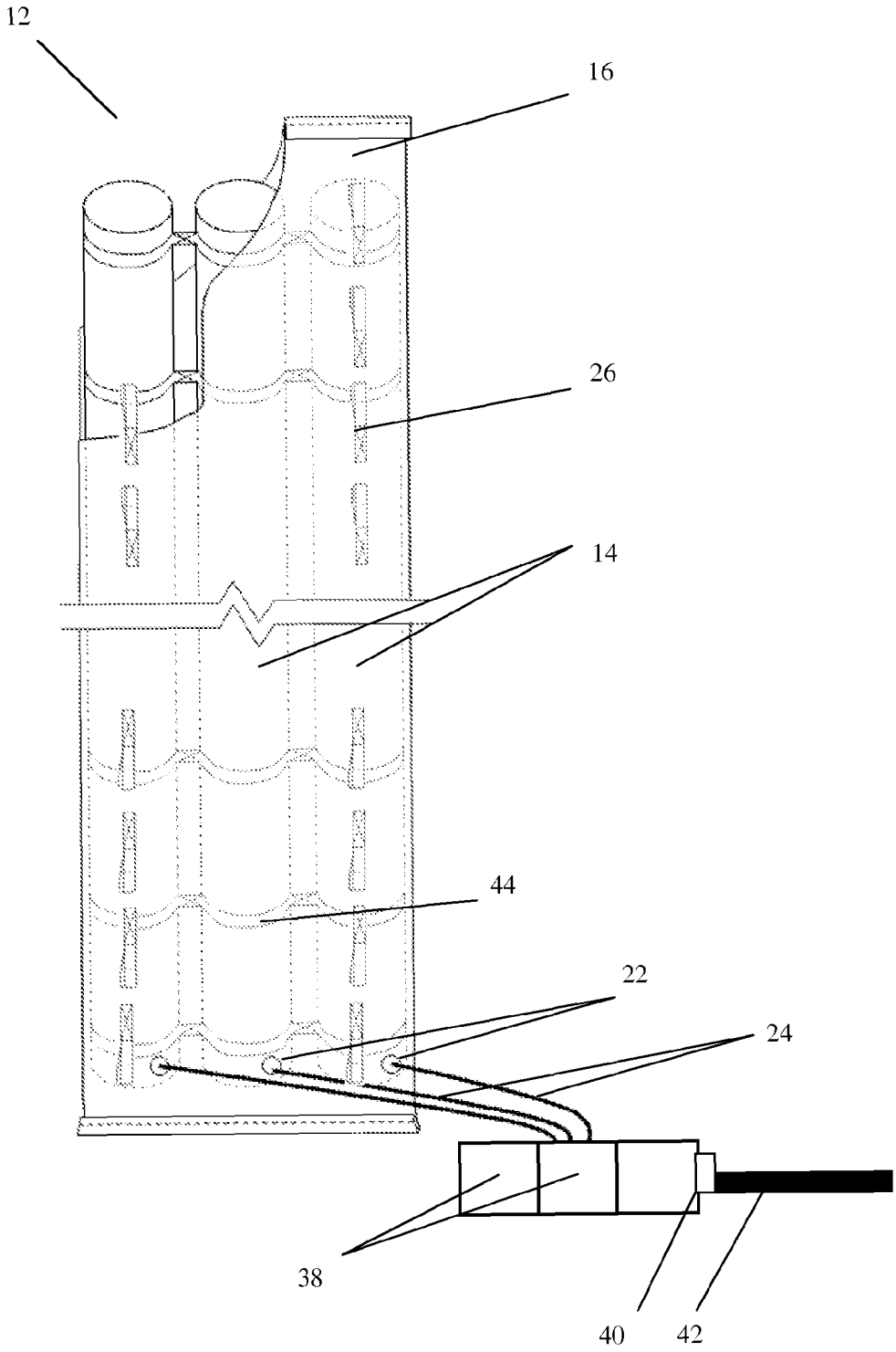
FIG. 3 is a perspective, partly cut away view of the bladder of a stope fill barrier according to a preferred embodiment of the present invention connected with a schematic view of a filling means.

With reference to FIG. 3, in accordance with a preferred embodiment of the present invention, the fillable bladder 12 comprises a plurality of inner bladders 14. The inner bladders 14 are contained within an outer bag 16. The outer bag 16 is preferably made from a wear and scuff-resistant material. More preferably, the outer bag 16 is made from a hard-wearing, heavy duty material.

Cable attachment points 26 are provided on the outer bag 16 of the bladder 12. In accordance with a preferred embodiment, the cable attachment points 26 are provided as loop handles. Preferably, the attachment points 26 are spaced at intervals between 100 millimetres (mm) and 1 metre (m), more preferably at about 500 mm intervals on both sides of one face of the bladder 12. The attachments points 26 are provided for a length of between 1 m and 10 m, preferably about a 5 m length at both an upper and lower end of the bladder 12.

In accordance with an additional embodiment of the present invention, the cable attachment points 26 may be provided as a continuous line, for example, a steel cable. The steel cable may be sewn or otherwise suitably attached to the fabric of the outer bag 16. The steel cable then allows for anchoring of additional ropes or cables 18 at varying points along the length of the bladder 12 thereby serving as cable attachment points 26.

Each inner bladder 14 comprises a connection 22 to facilitate coupling with the fluid lines 24 to enable filling of the inner bladders 14. In a preferred embodiment, the inner bladders 14 are capable of holding fluid pressures between 0.5 psi and 50 psi, preferably between 10 psi and 30 psi. Reinforcement banding 44 is provided on the inner bladders 14 which may allow for even filling of the inner bladders 14.

The fluid lines 24 connect with pressure regulators 38. Preferably, one pressure regulator is provided for each one fluid line 24 for each inner bladder 14. In use, the pressure regulators 38 maintain the requisite pressure of each of the inner bladders 14. At least one hose 42 is connected with the pressure regulators 38 through a coupling 40. Fluid for filling the inner bladders 14 is provided through the hose 42.

In use, an ore body to be mined, or stope 30, is provided underground. Using methods and techniques known in the art, an access drive 34 is provided beneath the stope 30. A stope void 28 is present adjacent to the stope 30 from previous mining activities.

In order to access the stope void for installation of the stope fill barrier 10, at least one access shaft 32 is drilled from the upper surface of the access drive 34, through the stope 30 to break through to the stope void 28 near the top of the stope 30. The shaft 32 may be drilled from below by a typical longhole drill and may be variable in diameter, preferably from 64 mm to 150 mm.

Ropes or cables 18 are placed within the access drive 34 end of the shaft 32 and are made to travel to the stope void 28 end of the shaft 32. The ropes or cables 18 are fed, lifted or pushed through the shaft 32 in any manner suitable for moving them to the required position.

The ropes or cables 18 are fed through the shaft 32 and allowed to fall from the stope 30 until they are within reach of the level of the access drive 34. The ropes or cables 18 are then retrieved from their position within stope void 28 to be pulled into the access drive 34. In a preferred embodiment, the ropes or cables 18 are retrieved using a pole and hook arrangement, operable from within the access drive 34. The pole is used to reach the ropes or cables 18 and the hook used to grab them. In another embodiment, the ropes or cables may be accessed using a vehicle driven into the stope void 28 to retrive the ropes or cables 18 and transport them to the access drive 34. The vehicle may be remotely operable.

The stope fill barrier 10 of the present invention is provided in the access drive 34 in preparation for installation. The ends of the ropes or cables 18 which have travelled through the shaft 32 are then attached to the stope fill barrier 10 in accordance with the present invention. Attachment points 26 are utilised for connection with the ropes or cables 18. The selection of suitable attachment points 26 is made for a resultant desired height of the bladder 12 relative to the end of the shaft 32 within the stope void 28. For example, if it is desired to have the top of the bladder 12 at the same height as that of the end of the shaft 32 in the stope void 28, then an attachment point 26 at the upper end of the bladder 12 would be used. If it is desired to have the top of the bladder 12 two metres higher than the end of the shaft 32 in the stope void 28, then an attachment point 26 two metres below the top of the bladder 12 would be utilised for connection with the ropes or cables 18.

Following connection of the ropes or cables 18 to the stope fill barrier 10, the bladder 12 is hoisted into position in the stope void 28 adjacent the stope 30. Any suitable method may be used for hoisting, such as manually or using a mechanical winch or pulling with a vehicle.

A further at least two ropes or cables 18 are attached to the lower end of the bladder 12. The at least two ropes or cables 18 at both the upper and lower ends of the bladder 12 are tensioned so that the bladder 12 is positioned firmly and restrained in a desired location between the stope void 28 and the adjacent stope 30. The ropes or cables 18 are tensioned with any suitable tensioning device or method and anchored to the anchor points 20. The lower end of the bladder 12 may be level with, above or below the level of the upper surface of the access drive 34.

Once the bladder 12 is in position and anchored, one end of each fluid line 24 may be coupled with a respective connection 22 on the inner bladders 14. A second end of each fluid line 24 may be connected with the corresponding pressure regulator 38, which is, in turn, connected with a hose 42 through a coupler 40. Fluid, for example mine air, is then brought from the hose through to fill the inner bladders 14 up to and kept at a required pressure by the pressure regulators 38.

With the stope fill barrier 10 in place to temporarily fill a portion of the stope void 28, the remainder of the stope void 28 may be backfilled according to normal and known methods. In a preferred embodiment, the portion of the stope void 28 filled by the stope fill barrier 10 is between about 50% and 100%, more preferably about 75% to 95% of the length between a top of the stope void 28 and an upper surface of the access drive 34.

After the filled stope void 28 has cured, the stope fill barrier 10 is preferably emptied and disconnected from the fluid lines 24 and filling means. The ropes or cables 18 may be removed from the anchor points 20 and the stope fill barrier uninstalled. In a second embodiment, the stope fill barrier 10 may remain in the backfill or be destroyed by subsequent blasting and mining operations.

The created space, from which the stope fill barrier 10 has been uninstalled, provides a relief void for subsequent blasting operations or removes the need for holes to be drilled in the next ore stope 30 and subsequent mining can commence immediately.

Modifications and variations as would be apparent to a skilled addressee are deemed to be within the scope of the present invention.

The invention claimed is:

1. A system for mining comprising the use of a stope fill barrier having a fluid-fillable bladder for temporarily filling a portion of a stope void directly adjacent to ore to be mined and creating a barrier between the stope void and adjacent ore, wherein the stope fill barrier is installed and positioned in the stope void from an access drive beneath the ore to be mined and wherein the system further comprises a shaft which is drilled from between an upper surface of the access drive to the stope void for the stope fill barrier to be installed from.

2. A system according to claim 1, wherein an end of the shaft at the stope void is located proximal to a top of the ore.

3. A system according to claim 1, wherein the portion of the stope void filled by the stope fill barrier is between 50% and 100% of a length between a top of the stope void and a lower surface of the ore.

4. A system according to claim 1, wherein the bladder is filled with fluid subsequent to installation.

5. A system according to claim 1, wherein the stope void is backfilled with the stope fill barrier installed within the stope void.

6. A system according to claim 1, wherein the stope fill barrier is anchored in place using tensioned ropes or cables fixed to anchor points below the ore.

7. A system according to claim 1, wherein the bladder is in connection with at least one pressure regulator to maintain pressure of the fluid-filled bladder.

8. A system according to claim 1, wherein the fluid-filled bladder is capable of holding fluid pressures of between 0.5 psi and 50 psi.

9. A system according to claim 1, wherein the bladder is made from a hard wearing, heavy duty, puncture resistant material.

10. A system according to claim 1, wherein the bladder comprises a plurality of bladders contained within an outer bag.

11. A system according to claim 1, wherein the bladder is arranged to be inflated with air.

* * * * *